US005735237A

United States Patent [19]

Phillip et al.

[11] Patent Number: 5,735,237

[45] Date of Patent: Apr. 7, 1998

[54] HOT WATER STORAGE HEATER

[75] Inventors: Peter J. Phillip, Hartsville; Darryl L. Ruark, Lugoff; Gary J. Potter, Bethune, all of S.C.

[73] Assignee: AOS Holding Company, Wilmington, Del.

[21] Appl. No.: 602,303

[22] Filed: Feb. 16, 1996

[51] Int. Cl.[6] ..... F22B 5/00

[52] U.S. Cl. ..... 122/13.1; 122/17

[58] Field of Search ..... 122/13.1, 17, 367.1, 122/367.2, 367.3

[56] References Cited

U.S. PATENT DOCUMENTS

| | | | |
|---|---|---|---|
| 2,147,046 | 2/1939 | Leoni | 122/15 |
| 2,385,854 | 10/1945 | Wolfersperger | 122/17 |
| 2,581,316 | 1/1952 | Wolfersperger | 431/8 |
| 2,651,294 | 9/1953 | Horne | 126/116 |
| 2,715,390 | 8/1955 | Tenney et al. | 122/24 |
| 2,787,318 | 4/1957 | Wolfersperger | 431/10 |
| 4,203,392 | 5/1980 | McLane | 122/17 |
| 4,492,185 | 1/1985 | Kendall et al. | 122/32 |
| 4,641,631 | 2/1987 | Jatana | 126/101 |
| 4,677,939 | 7/1987 | Henault et al. | 122/17 |
| 4,766,883 | 8/1988 | Cameron et al. | 126/351 |
| 5,022,352 | 6/1991 | Osborne et al. | 122/17 |
| 5,179,914 | 1/1993 | Moore, Jr. et al. | 122/17 |
| 5,195,502 | 3/1993 | Hanning | 126/360 R |
| 5,197,415 | 3/1993 | Stretch et al. | 122/17 |

*Primary Examiner*—Henry A. Bennett
*Assistant Examiner*—Gregory A. Wilson
*Attorney, Agent, or Firm*—Michael Best & Friedrich LLP

[57] ABSTRACT

The present invention is a commercial water heater comprising a tank dimensioned to hold a quantity of water, a blower, a heater, a heat exchanger in the water, and a control system. The heat exchanger includes a central tube running from the top of the tank to the bottom and a coil connected to and encircling the central tube. The heater is mounted inside the central tube, and the blower is mounted to the top of the tank, which together simplify manufacture and servicing. The blower is capable of delivering sufficient air for combustion at a pressure and velocity sufficient to drive the exhaust gases fifty feet beyond the water heater outlet, thus avoiding the need for a chimney. The water heater according to the present invention has an average efficiency of 93% with a 1% standby loss and is considerably cheaper to manufacture than other similarly efficient water heaters.

20 Claims, 3 Drawing Sheets

HOT WATER STORAGE HEATER

BACKGROUND OF THE INVENTION

1. Field of the Invention

The present invention relates to hot water heaters. In particular, the present invention relates to high-efficiency, commercial, gas-fired, hot water storage heaters.

2. Discussion of Background

Hot water on demand for bathing and washing was once a luxury but is now taken for granted in many countries throughout the world. To provide hot water to meet the demand, water is heated in a tank where it is stored in a heated condition so that, when the demand occurs, the heated water is immediately available for use. As water is drawn from the tank, cold water enters, mixes with the remaining hot water and the mixture is brought to the preselected temperature. These types of hot water heaters are referred to as storage hot water heaters, but will be referred to herein simply as water heaters.

There is, however, another type of water heater that heats water but does not store it. This type of heater is called an instantaneous water heater and typically holds ten gallons or less at any one time. These water heaters find use in applications where the demand for hot water is nearly continuous. For home use and many commercial applications, storage hot water heaters are preferred. In these applications, the demand is high during certain times of the day and low or nonexistent during the balance of the day.

Hot water storage heaters may be heated from the heat of combusted gas such as natural gas, propane or butane or by electrical resistance heating. Natural gas is cheaper than electricity (which may have been produced itself by burning natural gas or other fossil fuels), but electrical resistance heating is more efficient since all of the heat produced enters the stored water. A highly efficient gas-heated water storage heater is the most economical to operate.

There are significant differences between commercial and residential water heaters. In fact, there is a national industry standard, ANSI Z21.10.1, for residential water heaters and a different standard, ANSI Z21.10.3, for commercial water heaters. Commercial water heaters are classified as those that are rated at more than 75,000 btus per hour; residential water heaters are classified as those that are rated at 75,000 btus per hour or less. Also, residential water heaters heat water to a temperature no higher than 160° F.; commercial water heaters heat to 180° F.

There are other differences as well. The recovery rates, standby heat loss rates, and efficiencies of commercial water heaters are faster, lower and higher, respectively, than those of residential units. "Recovery rate" is the number of gallons of water the water heater can bring to temperature per hour and is usually a function of inlet water temperature and temperature setting. "Standby loss" is a measure of how much heat is lost over a twenty-four hour period without the addition of heat; standby loss is expressed in percents and is typically 2–3%. The efficiency of a water heater is a measure of how much heat from the combusted fuel is transferred to the water. Thus, a residential unit and a commercial unit may appear to be the same size. However, internally, the commercial unit will heat water to a higher temperature and more quickly, and be made to be considerably more robust and efficient. Somewhat ironically, capacity is not a factor that distinguishes commercial from residential hot water heaters, since both are typically 100 gallons or less.

Designing a water heater requires consideration of more than thermal efficiency. The cost of manufacturing the water heater is also important. Incremental efficiency increases will not always justify large changes in cost. Also, ease of installation and servicing are two other important factors in water heater design. Therefore, water heater designers must consider a number of factors, all to often conflicting factors, in making design decisions.

There are inevitably then a number of designs for water heaters. Most all, however, comprise an insulated tank sized to hold a quantity of water, a source of heat, a water inlet and outlet, and a heat exchanger immersed in the water in the tank. Several structural features are generally common to water heaters or at least many water heaters, although the specific compositions, geometries and interrelationships of components of similar but not identical water heaters oftentimes result in radically different performances. For example, the heat exchanger is sometimes a tube formed into a coil through which the hot combustion gases flow, giving up much of their heat to the water surrounding the coil.

In U.S. Pat. No. 4,492,185, Kendall et al. show such a coil in a residential water heater. Their water heater includes a heat exchanger comprising a central tube that runs vertically from the top of the heater approximately halfway down and then is formed into a coil that continues to the bottom of the tank.

Other examples of water heaters with coils exist in the art. For example, U.S. Pat. N. 4,203,392 discloses such a design, with the additional feature of a horizontal plate placed within the interior of the tank, which defines an upper or "super heated tank" and a lower "reserve tank." In addition, U.S. Pat. No. 2,581,316 and 2,787,318 both advance water heaters having a spiral heating coil running the length of the tank interior.

Nonetheless, because of the quantity of hot water used in today's society, there remains a need for a high efficiency, cost-efficient, gas-fired, commercial water storage heater.

SUMMARY OF THE INVENTION

According to its major aspects and briefly stated, the present invention is a gas-fired, commercial, hot water storage heater. In particular, the present invention is characterized by a small, efficient burner mounted inside a full length central tube in a tank of water and a large diameter coil encircling the central tube that, together with the tube, define enough surface area for efficient heat exchange to the water. A high powered air blower cooperates with the heater and heat exchanger to provide oxygen for combustion of the gas and pressure to drive the combustion gases through the water heater with at least enough force to avoid the need for a chimney. A water heater made according to the present invention operates with high efficiency, at 93% or higher, and is relatively low in cost to manufacture compared to other water heaters that are less efficient.

There are several important features of the present water heater. One is the use of a small but highly efficient heater mounted inside a larger diameter, full length central tube. Central, smaller diameter tubes are typically connected to large combustion chambers where combustion takes place. The hot combustion gases are then funneled into a small diameter central tube. In the present invention, however, the need for a separate combustion chamber is eliminated, along with the costs of manufacturing it and attaching it to the central tube, by using a larger diameter central tube, notwithstanding the greater flue loss associated with larger central tubes. Damage to the central tube from impinging combustion flames is eliminated by focusing the flame to reduce its diameter and lengthening the central tube. Significant manufacturing cost savings are obtained by the present design over prior designs.

Another important feature of the present invention is the construction of the coil. The coil is generally configured to run downhill in order to conduct condensate from the gradually cooling combustion gases out of the system. Therefore, because the central tube runs to the bottom of the tank, the initial portion of the coil runs directly upward to just below the mid-point of the tank, and then begins its coiling about the central tube in large-diameter, loose coils. The large diameter of the coils assures that the exhaust gas flow is not unduly constricted, and residency time of the gas and the surface area of the coils is such that there is a high degree of heat exchange.

Other features and their advantages will be apparent to those skilled in the art of commercial water heater design from a careful reading of the Detailed Description of A Preferred Embodiment accompanied by the following drawings.

DETAILED DESCRIPTION OF A PREFERRED EMBODIMENT

Figure 1:
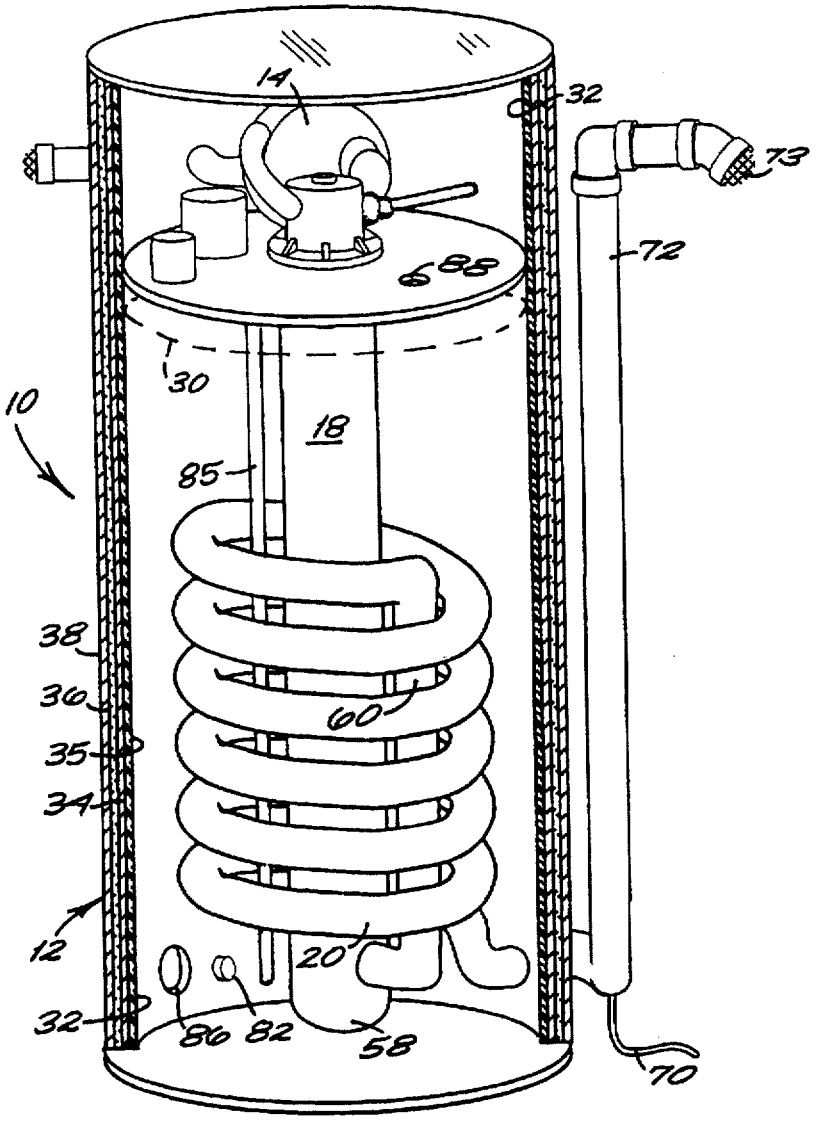
FIG. 1 is a partially cut away perspective view of a commercial water heater according to a preferred embodiment of the present invention.
Figure 2:
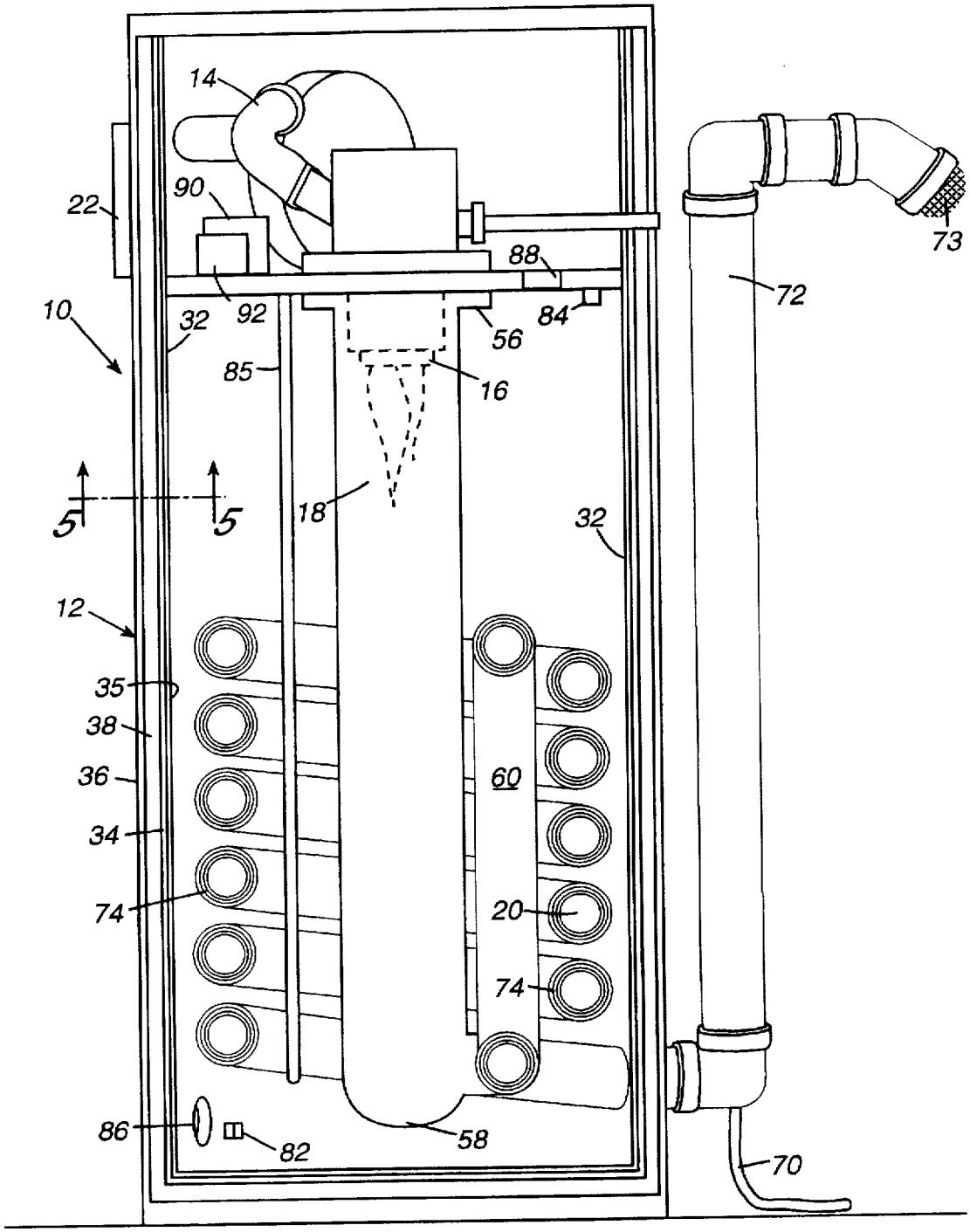
FIG. 2 is a cross sectional side view of a water heater according to a preferred embodiment of the present invention.
Figure 3:
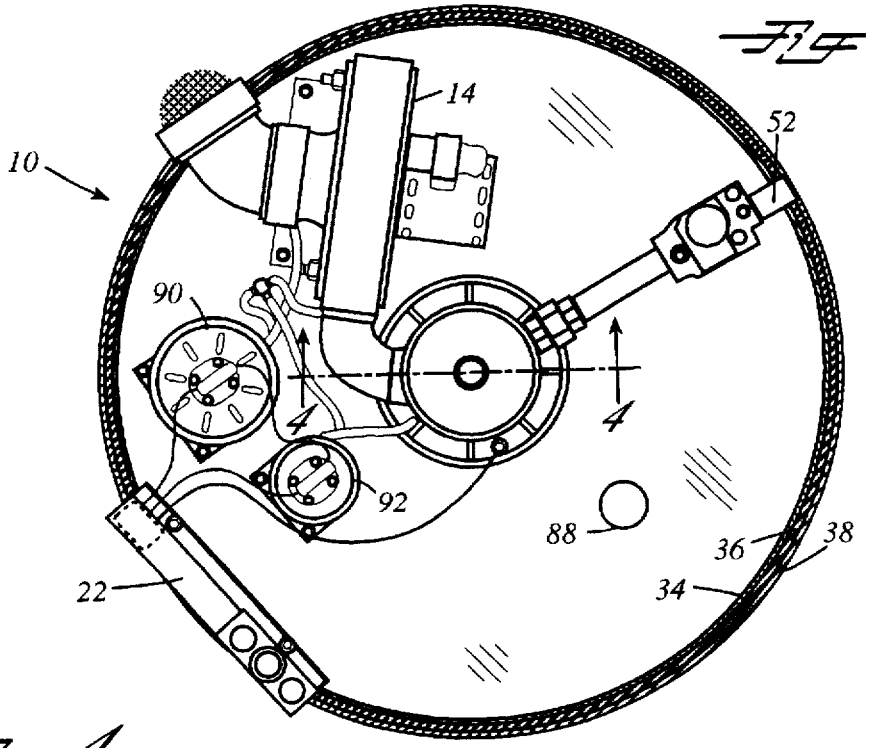
FIG. 3 is a cross sectional top view of a water heater according to a preferred embodiment of the present invention.
Figure 4:
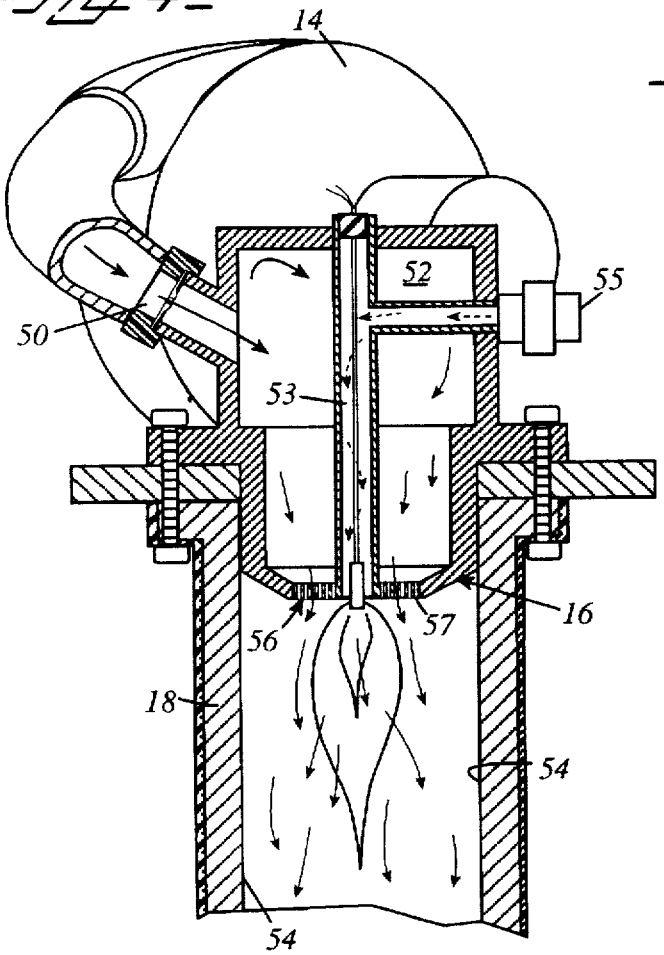
FIG. 4 is a detailed, cross sectional side view of the blower and burner of a water heater according to a preferred embodiment of the present invention taken along line 4—4 of FIG. 3.
Figure 5:
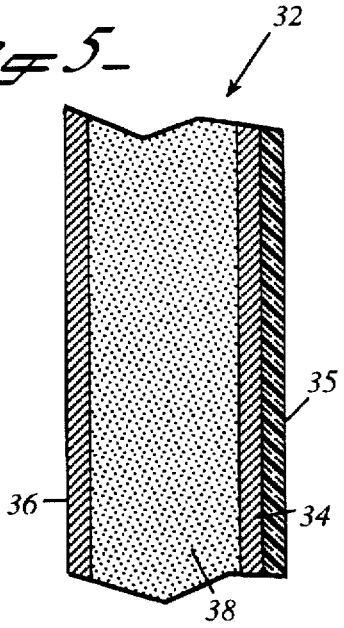
FIG. 5 is a detailed, cross sectional side view of the tank wall of a water heater according to a preferred embodiment of the present invention.

The present invention is a water heater. In particular, it is a low cost, commercial hot water storage heater having high efficiency and requiring zero clearance to walls and floor and no chimney.

Referring now to the figures, there is shown a water heater generally designated by reference number 10. The major components of water heater 10 are a tank 12, a blower 14, a burner 16, a central tube 18, a coil 20, and a control system 22. Taking each of these major components in turn, tank 12 is preferably a right cylinder dimensioned to hold a quantity of water 30 and having an insulated wall 32. Wall 32 construction is of a sandwich type composed of an inner layer 34, an outer layer 36 and a layer of insulation 38 therebetween. Inner layer 34 is preferably glass coated steel, with glass coating 35 serving to protect inner layer 34 from the corrosive effects of water 30. Outer layer 36 is preferably painted steel. Insulation 38 is preferably polyurethane foamed in place after inner and outer layers 34, 36, are assembled.

Blower 14 is mounted to the top of tank 12 and pumps air through a throat 50 into a first chamber 52. Throat 50 serves to accelerate air into first chamber 52. Positioned within first chamber 52 is a second chamber 53 which houses burner 16 and is in fluid communication with a gas line 55. Air in first chamber 52 and gas in second chamber 53 travel through throughholes 57 in plate 56 where the air and natural gas mix and are subsequently combusted. Blower 14 must provide sufficient air for complete combustion and enough air pressure to drive the combustion gases from water heater 10. Preferably, blower 14 will pump air at more than 4000 feet per minute and deliver a volume of approximately 150 cubic feet per minute. Throat 50 accelerates the air flow still further, preferably doubling its speed before it mixes with the gas.

Burner 16 may be any highly efficient, small diameter burner capable of burning a gas/air mixture to produce 240,000 btus/hour. Burner 16 must fit within central tube 18, which is preferably five inches in diameter. It must also produce a small diameter flame so that the flame does not impinge on the wall 54 of central tube 18. The flame will be long, and therefore, central tube 18 must extend substantially the full length of tank 12 so that the flame does not impinge on wall 54.

Central tube 18 is the first portion of a heat exchanger, with coil 20 being the second portion. Central tube 18 has hot gases running from burner 16 at its proximal end 56 to its distal end 58. A portion of this heat will be conducted through wall 54 and into water 30. In coil 20, a high percentage of the remainder of the heat will be exchanged into water 30. Coil 20 has a diameter approximately one-half that of central tube 18 so the flow of hot gases is somewhat restricted. Coil 20 coils around central tube 18 in a series of small pitch coils, generously spaced so that the residency time of the hot gases is large enough to permit nearly complete heat exchange. Because central tube 18 runs to the bottom of tank 12, coil 20 begins with a vertical length of tube 60 so that the balance of coil 20 runs downhill. As the hot gases cool, moisture in the gases condenses and must be removed from coil 20 so that it does not corrode the coil wall. The temperature of the gases is too high for condensation in central tube 18, but toward the end of coil 20, condensation occurs. At the very end of coil 20 is a drain line 70 to remove condensates to an external drain (not shown). Gas exiting coil 20 is forwarded through an exhaust pipe 72, external to tank 12, and is exhausted through opening 73 into the atmosphere. Central tube 18 and coil 20 are made of metal. The outside of wall 54 of central tube 18 is glass coated to prevent corrosion in its contact with water 30. The inside and outside of the wall 74 of coil 20 is coated with glass to prevent corrosion caused by condensate in coil 20 and water 30 in tank 12, respectively.

Control system 22 electronically controls two sensors 82 and 84, blower 14 and burner 16. Sensor 82 is an inlet thermostat; sensor 84 is an outlet thermostat. Sensor 82 is triggered when cold water enters inlet 86 and turns on burner 16. Sensor 84 is a high temperature sensor and turns off burner 16 when the temperature of water 30 exiting through outlet 88 reaches a preselected setpoint. The influx of cold water, heating it, the removal of water 30 from the tank 12, and the volume of water 30 as a function of height make it difficult to ascertain by calculation what the temperature of the water 30 in tank 12 is. However, by weighting the output signals of sensors 82 and 84, an approximate overall water temperature can be obtained for water 30 within tank 12. It has been determined that the following calculation provides an estimate for the temperature of water 30 within tank 12:

$$T=((\text{temp}(F.^\circ)\text{measured at sensor } 84\times 6)+(\text{temp } (F.^\circ)\text{measured at sensor } 82))/7$$

Control system 22 also controls differential pressure switches 90 and 92. Switch 90 senses a differential pressure across blower 14. When a certain pressure across blower 14 is sensed by switch 90, an electrical signal is sent to control system 22 signifying the movement of air. Upon receipt of this signal, control system 22 will initiate the ignition of burner 16. Switch 92 measures a back pressure in burner 16. If burner 16 becomes blocked, switch 92 opens and control system 22 will shut down water heater 10.

Within tank 12 is an anode 85. Anode 85 is electrically insulated from tank 12, which serves as the cathode. In operation, anode 85 is held at a slight positive electrical potential with respect to tank 12. Glass coating 35 on the inside of inner layer 34 inevitably will have fine holes where the surface of inner layer 34 will be exposed to water 30. By applying the slight potential difference to anode 85, the direction of ionic movement will be from anode 85 to the cathode through the water, resulting in a slow degradation of anode 85. This direction of movement prevents inner layer 34 from degrading, however. A suitable anode 85 can be made of aluminum or magnesium.

The precise geometry of a water heater according to the present invention will vary depending on a number of factors. However, an example of a water heater design, for a commercial, 180° F., water heater with a storage capacity of 100 gallons is a 24 inch diameter tank 12 having zero clearance on all sides and a 1½ inch clearance on top for maintenance, a burner 16 rated at 240,000 btu/hour and operating in a five inch central tube 18 having a 0.111 inch thick wall. It is supplied with air from blower 14 capable of producing almost 4400 feet/minute of air for oxygen supply and pressure to drive the gases through fifty feet of exhaust pipe, and produces a flame eight inches below the top of the water. The wall of coil 20 is 0.060 inches thick. Sensors 82 and 84 are weighted 1:6 in determining water temperature. Such a heater will have a standby loss rate of 1% and an average efficiency of 93%.

It will be apparent to those skilled in the art of hot water heater design that many changes and modifications can be made to the preferred embodiment described herein without departing from the spirit and scope of the present invention which is defined by the appended claims.

What is claimed is:

1. A water heater comprising:

a tank dimensioned for containing a quantity of water;

a hollow tube in said tank;

a hollow coil in said tank and connected with said tube so that said coil and said tube are in fluid communication;

said tank having a top and a bottom and said hollow tube having a top and a bottom, and wherein said top of said hollow tube is positioned in said top of said tank and said bottom of said hollow tube is positioned in said bottom of said tank, and wherein said coil is connected to said bottom of said hollow tube wherefrom said coil rises and then coils about said hollow tube toward said bottom of said tank;

means for combusting a mixture of gas and air, said combusting means being positioned so that combustion of said mixture takes place within said hollow tube; and means for pumping air into said combusting means, said pumping means being in fluid communication with said hollow tube.

2. The water heater as recited in claim 1, wherein said hollow tube has a diameter that does not exceed approximately five inches.

3. The water heater as recited in claim 1, wherein said hollow tube runs substantially the full length of said tank.

4. The water heater as recited in claim 1, wherein said pumping means pumps air at a first velocity, and wherein said pumping means further comprises means for accelerating said air to a second velocity prior to combustion, said second velocity being approximately twice said first velocity.

5. The water heater as recited in claim 1, wherein said pumping means pumps air at a first velocity sufficient to drive combustion gases from combustion of said mixture through said hollow tube and said coil and then through a fifty-foot vertical stand of pipe.

6. A water heater, comprising:

a tank dimensioned for containing a quantity of water, said tank having a top and a bottom;

a hollow tube in said tank, said hollow tube having a top and a bottom, said top of said hollow tube being positioned in said top of said tank and said bottom of said hollow tank being positioned in said bottom of said tank so that said hollow tube runs substantially the length of said tank;

a hollow coil in said tank and connected with said tube so that said coil and said tube are in fluid communication, said coil rising vertically from said bottom of said tank partway toward said top of said tank and then coiling downward about said hollow tube toward said bottom of said tank;

means for combusting a mixture of gas and air so that hot combustion gases are directed through said hollow tube from said top of said tube to said bottom of said tube; and means for pumping air into said combusting means, said pumping means being in fluid communication with said combusting means.

7. The water heater as recited in claim 6, wherein said hollow tube has a diameter not greater than approximately five inches.

8. The water heater as recited in claim 6, wherein said combusting means is positioned inside said hollow tube.

9. The water heater as recited in claim 6, wherein said hollow tube has a diameter not greater than approximately five inches and wherein said combustion means is positioned inside said hollow tube.

10. The water heater as recited in claim 6, wherein said pumping means pumps air at a velocity sufficient to drive combustion gases from combusting said mixture through said hollow tube and said coil and then exhaust said gases through a fifty-foot vertical stand of pipe.

11. The water heater as recited in claim 6, wherein said coil has a diameter half that of said hollow tube.

12. The water heater as recited in claim 6, wherein said coil is dimensioned so that an average of 93% of heat released by combustion of said mixture is transferred to said water in said tank.

13. The water heater as recited in claim 6, further comprising an anode positioned inside said tank and electrically isolated from said tank.

14. A water heater, comprising:

a tank dimensioned for containing a quantity of water, said tank having a top and a bottom;

a hollow tube in said tank, said hollow tube having a top and a bottom, said top of said hollow tube being positioned in said top of said tank;

a hollow coil in said tank and connected with said tube so that said coil and said tube are in fluid communication, said coil rising vertically from said bottom of said tank partway toward said top of said tank and then coiling downward about said hollow tube toward said bottom of said tank;

means within said hollow tube for combusting a mixture of gas and air so that hot combustion gases are directed through said hollow tube from said top of said tube to said bottom of said tube; and means for pumping air into said combusting means, said pumping means being in fluid communication with said combusting means, said coil dimensioned so that an average of 93% of heat released by combustion of said mixture is transferred to said water.

15. The water heater as recited in claim 14, wherein said hollow tube has a diameter of not more than approximately 5 inches.

16. The water heater as recited in claim 14, wherein said pumping means pumps said air at a velocity of at least approximately 4400 feet per minute.

17. The water heater as recited in claim 14, wherein said pumping means pumps at least approximately 150 cubic feet of air per minute.

18. The water heater as recited in claim 14, wherein said bottom of said hollow tube is positioned in said bottom of said tank so that said hollow tube runs substantially the length of said tank.

19. The water heater as recited in claim 1, wherein said hollow tube has a diameter not exceeding approximately five inches, and wherein said hollow tube runs substantially the full length of said tank.

20. The water heater as recited in claim 1, wherein said pumping means pumps air at a first velocity sufficient to drive combustion gases from combustion of said mixture through said hollow tube and said coil and then through a fifty-foot vertical stand of pipe, and wherein said pumping means further comprises means for accelerating said air to a second velocity prior to combustion, said second velocity being approximately twice said first velocity.

* * * * *